US008366489B2

(12) United States Patent
Kobayashi et al.

(10) Patent No.: US 8,366,489 B2
(45) Date of Patent: Feb. 5, 2013

(54) RELAY CONNECTOR

(75) Inventors: Kotaro Kobayashi, Atsugi (JP); Naoya Matsuura, Yokohama (JP); Hisaya Suzuki, Shizuoka (JP); Akira Fukai, Fujieda (JP); Masahiro Motomiya, Fijieda (JP)

(73) Assignees: Molex Incorporated, Lisle, IL (US); Murakami Corporation, Suruga-ku, Shizuoka (JP)

( * ) Notice: Subject to any disclaimer, the term of this patent is extended or adjusted under 35 U.S.C. 154(b) by 820 days.

(21) Appl. No.: 11/887,793

(22) PCT Filed: Apr. 5, 2006

(86) PCT No.: PCT/US2006/012956

§ 371 (c)(1),
(2), (4) Date: Sep. 23, 2011

(87) PCT Pub. No.: WO2006/108117

PCT Pub. Date: Oct. 12, 2006

(65) Prior Publication Data

US 2012/0115354 A1 May 10, 2012

(30) Foreign Application Priority Data

Apr. 5, 2005 (JP) ..... 2005-108891

(51) Int. Cl.
*H01R 25/00* (2006.01)

(52) U.S. Cl. ..... 439/650

(58) Field of Classification Search ..... 439/350, 439/638; 310/71
See application file for complete search history.

(56) References Cited

U.S. PATENT DOCUMENTS 5,896,238 A * 4/1999 Hubscher et al. ..... 359/877
6,132,052 A * 10/2000 Huizenga et al. ..... 359/877

FOREIGN PATENT DOCUMENTS

EP 0 331 744 A1 9/1989
EP 1 279 556 A2 1/2003

OTHER PUBLICATIONS

International Search Report for PCT/US06/012956.

* cited by examiner

*Primary Examiner* — Phuong Dinh
(74) *Attorney, Agent, or Firm* — Larry T. Golden

(57) ABSTRACT

Provided is a relay connector 100 for establishing connection between motors each having a pair of motor terminals provided to a back plate, and for supplying power supplied from external terminals to the respective motor terminals. The relay connector 100 includes: a motor connecting surface 120 having a first relay terminal 140 that connects to the motor terminals of each motor; an external connector connecting surface 130 that is continuous to the motor connecting surface 120 and has in its bonding surface a second relay terminal 150 that connects to L-shaped terminals 220; and a housing 110 having the motor connecting surface 120 and the external connector connecting surface 130 in its end surfaces. The first relay terminal 140 and the second relay terminal 150 are electrically connected with each other within the housing 110.

5 Claims, 17 Drawing Sheets

RELAY CONNECTOR

TECHNICAL FIELD

The present invention relates to a connector, and more specifically to a relay connector that can be suitably used for connecting a motor and an external terminal to each other.

BACKGROUND ART

Miniature-motor connectors are known in the art, as disclosed in Patent Document 1 below.

The connector disclosed is a relay connector that can be used to connect a motor having a pair of male terminals provided in an endplate to a printed board. The relay connector includes a connector pin connected to one of the male terminals, a connector pin connected to the other of the male terminals, a connector main body accommodating the connector pins, and an insertion hole through which the distal end portions of the two connector pins are exposed.

When mounting the miniature motor, the connector is first incorporated into the motor from the endplate side of the motor, and then a printed board having a power line and a ground line is fitted into the insertion hole of the connector main body.

In this way, the motor can be mounted to the printed board without requiring a cumbersome wire connection.

DISCLOSURE OF THE INVENTION

In recent years, motor units incorporating multiple built-in motors are used in various fields. Known representative examples thereof include motor units incorporated in automobile door mirrors or back monitor cameras. In those devices, two motors are usually individually controlled and driven, thus adjusting the angle of a mirror or a lens.

With the devices of this type, due to the requirement of incorporating a complex mechanism including the motors into a narrow space inside the casing, various contrivances have been made as to the motor wiring method. That is, considering the space occupied by the motor wiring portion and the ease of wiring operation, it is desirable to draw out the wiring in the radial direction of the motors. To meet this requirement, as shown in FIG. 18, there is employed a side terminal type motor 300 having two female terminals 323, 324, in its one side surface.

Further, when two side terminal type motors 300 arranged side by side are to be incorporated into the casing, as shown in FIG. 17, they are incorporated in such a layout that the motors 300 are orientated in the same direction. The adoption of this layout enables the wiring operations for the respective motors 300 to be collectively processed in the space above the motors 300 which otherwise would be a dead space.

However, such a side terminal type motor is rather unique in structure and lacks general-purpose property, and hence is more expensive than general-purpose motors.

Further, when multiple motors are incorporated in the above-described layout, regarding the vertical-to-lateral ratio of the space occupied by the motors, the lateral ratio becomes relatively large. Accordingly, the above layout is not necessarily an efficient one in cases where a sufficient motor installation area cannot be secured in the lateral direction of the casing.

The present invention has been made in view of the technical background as described above, and therefore it is an object of the invention to provide a relay connector which allows use of a general-purpose motor that is less expensive and which facilitates the wiring operation for the motor.

Means for Solving the Problems

The present invention adopts the following means in order to solve the above-mentioned problems. That is, according to the present invention, there is provided a relay connector for connecting motors with each other, the motors each having a back plate supporting an end portion of a rotor and a pair of motor terminals provided to the back plate, and for supplying electric power fed through external terminals to the motors, the relay connector including a housing having a first bonding surface and a second bonding surface, characterized in that: the first bonding surface has a first relay terminal connected to the motor terminals of the respective motors; the second bonding surface is provided in a surface different from the first bonding surface and has a second relay terminal connected to the external terminals; and the first relay terminal and the second relay terminal are electrically connected with each other within the housing.

As described above, the electric power supplied from the external terminal is supplied to the respective motors from the back plate side of the motors via the second relay terminal provided to the second bonding surface and via the first relay terminal provided to the first bonding surface.

According to the present invention, general-purpose motors each having the motor terminals on the back plate side thereof can be connected to the relay connector for connection to the external terminals. The operation of connecting the external terminals to the respective motors can be performed on the second bonding surface side of the relay connector, that is, in the dead space located in the radial direction of the motors.

It is preferable that the second relay terminal be provided in the second bonding surface such that a direction in which the external terminals are connected to the second relay terminal is at a right angle to a direction in which the first relay terminal is connected to the motor terminals.

With this construction, the external terminals can be connected to the motor terminals in the radial direction of the motors. Further, the wire connection operation for the second relay terminal is facilitated. It should be noted that the expression "at a right angle to the direction of connection" is not intended to mean strictly 90 degrees but may cover a range of angles as long as the angle enables wiring operation in the second bonding surface.

Preferably, the first relay terminal include power supply terminals connected to the motor terminals used to supply power to the respective motors, and include ground short-circuit terminals connected to the motor terminals used for grounding connection of the respective motors; the respective power supply terminals be provided independently within the housing in correspondence with the respective motors; and that the respective ground short-circuit terminals be provided within the housing in a state in which the ground short-circuit terminals are connected with each other. However, the ground short-circuit terminals may not be necessarily short-circuited; they may be provided independently as ground terminals while being connected with each other.

When, as described above, the ground short-circuit terminals are connected with each other within the relay connector in advance, it is not necessary to connect the wiring and terminals corresponding to the ground of each motor on the external terminal side for each of the motors.

A construction may also be adopted in which a connecting terminal for connecting the power supply terminals and the ground short-circuit terminals with each other is provided within the housing, and the connecting terminal is provided with an electronic element mounting portion for electrically connecting, between the power supply terminals and the ground short-circuit terminals, an electronic element for preventing generation of noise by the motors.

When the electronic element is provided within the relay connector in advance, the wiring operation relating to the electronic element can be completed before connecting the relay connector to the motors . Is should be noted that any electronic element suffices as long as it can eliminate noise generated by the motors. Examples thereof may include a condenser, a resistor, a filter, and a varistor.

It is preferable that the motor surround an outer periphery of the rotor and have parallel side end surfaces at its radially opposing portions, and that the power supply terminals and the ground short-circuit terminals be provided in the first bonding surface in conformity with a layout enabling a mounting arrangement in which the side end surfaces of the pair of motors are opposed to each other and the side end surfaces are in close proximity to each other.

As described above, the power supply terminals and the ground terminals are provided to the first bonding surface in conformity with the terminal layout permitting a mounting arrangement in which, upon mounting the motors, the side wall surface of one motor and the side wall surface of the other motor are opposed and in close proximity to each other. Accordingly, the motors can be connected to the relay connector in a side-by-side arrangement in the layout that makes the vertical-to-lateral ratio minimum upon mounting the motors. It should be noted that the mounting arrangement enabling the placement of the side end surfaces in close proximity is not necessarily limited to one in which the side end surfaces are brought into contact with each other; it suffices that the side end surfaces be opposed to each other to thereby achieve reduced vertical-to-lateral ratio upon mounting of the motors.

Further, the various constructions described above as means for solving the problems may be combined with each other as appropriate without departing from the object and technical idea of the present invention.

Effect of the Invention

As described above, according to the present invention, inexpensive general-purpose motors can be used. Further, the wiring operation for the motors is easy, enabling installation of the motors in the limited space inside the casing. Further, the wiring operation is easy, and moreover the vertical-to-lateral ratio upon mounting the motors can be reduced, thereby making it possible to achieve the miniaturization of the casing.

Hereinbelow, an embodiment of the present invention as applied to a mirror surface angle adjusting mechanism of a vehicle door mirror will be described with reference to the drawings.

First, a door mirror angle adjusting mechanism will be described.

As shown in FIG. 2, like a general-purpose angle adjusting mechanism, the angle adjusting mechanism according to this embodiment includes, for example, a holder with a mirror provided in its surface, a support portion supporting the holder from the rear surface side at a freely adjustable angle, and a casing 10*a* accommodating a motor unit 10 provided adjacent to the support portion.

The motor unit 10 includes a first motor 20 for adjusting the angle of the holder (not shown) in the vertical direction of a vehicle, a second motor 30 for adjusting the angle of the holder in the lateral direction of the vehicle, and a connector unit C for supplying electric power to the first motor 20 and the second motor 30. Further, a known turning mechanism equipped with a pinion gear, a worm gear, etc. and used for turning the holder, is attached to respective output shafts 21, 31 of the first and second motors 20, 30. When electric power is supplied to the first and second motors 20, 30 as appropriate, the output shafts 21, 31 thereof rotate, whereby the holder is supported at a desired angle.

In this embodiment, a general-purpose motor as shown in FIG. 15 is used as each of the first and second motors 20 (30). The general-purpose motor includes a rotor provided therein, the output shaft 21 (31) that rotates integrally with the rotor, a back plate 22 (32) supporting the rotor, a pair of motor terminals 23, 24 (33, 34) provided to the back plate 22 (23), and a casing 26 (36) surrounding the outer periphery of the rotor and having parallel side end surfaces 25 (35) its radially opposing portions.

The connector unit C includes a relay connector 100 for connecting the first and second motors 20, 30 in parallel, and an external connector 200 for supplying electric power to the relay connector 100.

As shown in FIGS. 6 and 7, the relay connector 100 includes a substantially rectangular housing 110, and a first relay terminal 140 and a second relay terminal 150 which are incorporated in the housing 110.

The housing 110 includes a motor connecting surface 120 located on the back plate 22 (32) side of the first and second motors 20, 30 at the time of mounting the first and second motors 20, 30, and an external connector connecting surface 130 to which the external connector 200 is attached.

Further, the motor connecting surface 120 (first bonding surface) and the external connector connecting surface 130 (second bonding surface) are connected to each other via a right-angled edge portion 111 (bent portion).

Referring to FIG. 6, the bonding surface located on the front surface side of the housing 110 is the motor connecting surface 120, and the bonding surface corresponding to the top surface of the housing 110 is the external connector connecting surface 120.

Hereinbelow, for the convenience of description, the vertical and lateral positional relation as seen in FIG. 6 is employed for the description of the relay connector 100 according to this embodiment.

Provided in the motor connecting surface 120 located on the front surface of the housing 110 is the first relay terminal 140 that can be electrically connected to the motor terminals 23, 24, 33, 34. The first relay terminal 140 has: power supply terminals 140*a* connected to the motor terminals 23, 33, which are used for power supply to the first motors 20, 30, to supply electric power to the first and second motors 20, 30; and ground short-circuit terminals 140*b* connected to the motor terminals 24, 34 respectively used for grounding connection in the first and second motors 20, 30.

Female terminals located in the upper right and upper left of FIGS. 6 and 7, respectively, are the power supply terminals 140*a*. The power supply terminals 140*a* are each exposed through a power supply terminal insertion opening 121 provided in the motor connecting surface 120. Further, male terminals located in the lower right and lower left of FIGS. 6 and 7, respectively, are the ground short-circuit terminals 140*b*. The ground short-circuit terminals 140*b* are each exposed through a ground short-circuit terminal insertion opening 122 provided in the motor connecting surface 120.

Further, in correspondence with the respective first and second motors 20, 30, one power supply terminal 140*a* and one ground short-circuit terminal 140*b* are arranged in the vertical direction of the motor connecting surface 120, and one power supply terminal 140*a* and one ground short-circuit terminal 140*b* are arranged in the lateral direction of the motor connecting surface 120.

The power supply terminals 140*a* and the ground short-circuit terminals 140*b* are provided in the motor connecting surface 120 in conformity with the terminal layout that permits a mounting arrangement in which, upon mounting the first and second motors 20, 30, the side end surfaces 25, 35 of the first and second motors 20, 30 are located so as to be opposed and in close proximity to each other.

More specifically, as shown in FIG. 16, the distance between the power supply terminals 140*a* arranged side by side, and the distance between the ground short-circuit terminals 140*b* arranged side by side, are determined in conformity with amounting arrangement in which the side end surfaces 25, 35 of the first and second motors 20, 30 are opposed and in close proximity to each other.

That is, a distance La (the distance between bearing portions 27 (37)) shown in FIG. 16 corresponds to a distance L between adjacent ones of the respective terminals 140*a*, 140*b* shown in FIG. 6. Accordingly, the first and second motors 20, 30 can be mounted to the motor connecting surface 120 in a side-by-side arrangement according to a layout that makes the vertical-to-lateral ratio minimum upon mounting the motors.

Subsequently, the external connector connecting surface 130 will be described (see FIGS. 9 through 12).

The second relay terminal 150 is provided in the external connector connecting surface 130 located on the top surface of the housing 110.

The second relay terminal 150 includes external power introducing terminals 150*a* for supplying power to the power supply terminals 140*a* provided in the motor connecting surface 120, and an external ground short-circuit terminal 150*b* for connecting the ground short-circuit terminals 140*b* to the ground. Within the housing 110, the external power supply terminals 150*a* and the external ground short-circuit terminal 150*b* are respectively electrically connected to the corresponding power supply terminals 140*a* and the ground short-circuit terminals 140*b* on the motor connecting surface 120 side.

Further, formed in the external connector connecting surface 13 are insertion holes 131 through each of which the external power introducing terminal 150*a* is exposed, and an insertion hole 132 through which the external ground short-circuit terminal 150*b* is exposed, the insertion holes 131 and 132 opening upwards from the housing 110. The external connector 200 that will be described later in detail is connected to the external power introducing terminals 150*a* and the external ground short-circuit terminal 150*b*.

As shown in FIG. 11, each external power introducing terminal 150*a* and each power supply terminal 140*a* are formed integrally with each other. The external power introducing terminal 150*a* and the power supply terminal 140*a* are incorporated in the housing 110 independently as an integrated contact.

On the other hand, as shown in FIG. 12, the two ground short-circuit terminals 140*b* provided to the motor connecting surface 120 are connected with each other, with one external ground short-circuit terminal 150*b* being electrically connected to the integrated assembly of the ground short-circuit terminals 140*b*, 140*b*. That is, the ground short-circuit terminal 140*b* arranged on the right-hand side of the motor connecting surface 120, the ground short-circuit terminal 140*b* arranged on the left-hand side of the motor connecting surface 120, and the external ground short-circuit terminal 150*b* are integrated with one another.

In the following description, a contact having the external power introducing terminal 150*a* and the power supply terminal 140*a*, and a contact having the external ground short-circuit terminal 150*b* and the ground short-circuit terminal 140*b*, are often referred to as a power contact X and a grounding contact Y, respectively.

In this embodiment, a connecting terminal 160 (hereinafter referred to as "connecting contact Z") for connecting the power contact X and the grounding contact Y with each other within the housing 110 is provided in the housing 110.

Further, a contact portion 161 as shown in FIG. 13 is provided substantially at the central portion of the connecting contact Z. The electrical contact between the connecting contact Z and the grounding contact Y having the ground short-circuit terminal 140*b* is maintained by means of the contact portion 161.

Formed in the connecting contact Z is a condenser mounting portion 162 (electronic element mounting portion) for electrically disposing a condenser 170 (electronic element), which prevents noise generation by the first and second motors 20, 30, between the power contact X and the grounding contact Y (see FIG. 9).

The condenser mounting portion 162 will be described in detail. The power contact X constituting the power supply terminal 140*a* is provided with a condenser contacting portion 163 that contacts the condenser 170. On the connecting contact Z side, there is provided a pressurizing/contacting portion 164 which, when incorporated into the housing 110, electrically connects with the condenser 170 and pressurizes the condenser 170 toward the condenser contacting portion 163. That is, electrical connection for the condenser 170 is established by the condenser contacting portion 163 and the pressurizing/contacting portion 164.

Further, an accommodating portion 114 into which the contacts X, Y, Z are incorporated is formed in the end surface of the housing 110 which is opposite to the motor connecting surface 120. By incorporating the contacts X, Y, X into the accommodating portion 114, the power contact X and the grounding contact Y are electrically connected with each other via the condenser 170 by themselves.

The general-purpose motor employed in this embodiment has the rotor bearing portion 27 (37) protruding on the back plate 22 (23) side. Accordingly, the housing 110 constituting the motor connecting surface 120 is provided with a recess 115 having a depth permitting the protrusion of the bearing portion 27 (37). Upon mounting the first and second motors 20, 30, the recess 115 serves to prevent the interference between the housing 110, which constitutes the motor connecting surface 120, and the bearing portion 27 (37).

Hereinafter, the external connector 200 will be described.

The external connector 200 can be freely inserted onto and extracted from the second relay terminal 150 composed of a plurality of terminals including the external power supply terminal 150*a*, the outer ground short-circuit terminal 150*b*, and the like, and includes a plurality of L-shaped terminals 220 as external terminals. Further, the external connector 200 includes a housing 210 accommodating the L-shaped terminals 220. The L-shaped terminals 220 are provided within the housing 210 such that their distal end portions extend toward the external connector connecting surface 130 side. Further, the L-shaped terminals 220 are connected by crimping to power lines 180 and ground lines 181.

Further, the housing 210 is provided with engaging claws 214 for fixing the housing 210 onto the casing 10*a* of the motor unit 10. Further, when connected with the relay connector 100, the housing 210 extends in the axial direction of the first and second motors 20, 30, with the distal end portions of the L-shaped terminals 220 being electrically connected to the corresponding terminals 150*a*, 150*b* of the second relay terminal 150 provided in the external connector connecting surface 130. That is, upon connection with the relay connector 100, the external connector 200 is incorporated into the motor unit 10 so as to cover the portions above the first and second motors 20, 30.

Here, the relative connection angles between the L-shaped terminals 220 and the above-described second relay terminal 150, and between the first relay terminal 140 and the motor terminals 23, 24 (33, 34) will be described. The L-shaped terminals 220 are connected to the second relay terminal 150 from above the housing 110, and the motor terminals 23, 23 (33, 34) are connected to the first relay terminal 140 from the lateral sides of the housing 110. Accordingly, the second relay terminal 150 is disposed such that the direction in which the first relay terminal 140 is connected to the motor terminals 23, 24 (33, 34) is at the right angle relative to the direction in which the L-shaped terminals 220 are connected.

As described above, in the connector unit C according to this embodiment, electric power supplied from the L-shaped terminals 220 is supplied to the first and second motors 20, 30 from the back plate 22 (32) side of the first and second motors 20, 30 via the second relay terminal 150 provided in the external connector connecting surface 130 and via the first relay terminal 140 provided in the motor connecting surface 120. This makes it practically possible to connect the L-shaped terminals 220, which are external terminals, to the motor terminals 23, 24 (33, 34) in the radial direction, whereby wiring operation for the first and second motors 20, 30 can be performed in the dead space located above the first and second motors 20, 30.

The above-described embodiment is given merely as an example, and the specific details thereof may be suitably as desired.

For example, the following constructions are conceivable: one in which the motors are mounted to the motor connecting surface 120 by forming a receiving guide groove while sliding the motor terminals 23, 24 (33, 34) on the side portion of the motor connecting surface 120; one in which, instead of the L-shaped terminals 220, straight type external terminals are inserted from above the relay connector 100; and one in which three motors or more, instead of two motors, are mounted. In the above-described embodiment, in order to mount the condenser 170, the external ground terminal 150*b* is provided such that it is electrically connected with the plurality of ground short-circuit terminals 140*b* to thereby establish electrical connection with one L-shaped terminal 220; however, in the case where no condenser 170 is to be mounted, the external ground terminal 150*b* may be mounted in a one-to-one type electrical connection.

Further, while in the above-described embodiment the description is directed to the case where the relay connector 100 is employed for the angle adjusting mechanism for a vehicle door mirror, the electrical connector of the present invention is applicable to the whole range of apparatuses using a motor unit incorporating a plurality of motors arranged side by side.

Further, the foregoing description is directed to the case where, as shown in FIG. 12, the two ground short-circuit terminals 140*b* provided to the motor connecting surface 120 are connected to each other, with one external ground short-circuit terminal 150*b* being electrically connected to the integrated assembly of the ground short-circuit terminals 140*b*, 140*b*. However, the ground short-circuit terminals 140*b*, 140*b* may not necessarily be short-circuited to each other. Accordingly, it is also possible to provide ground short-circuit terminals 140*b* that are not connected to each other but rather independent from each other.

Figure 1:
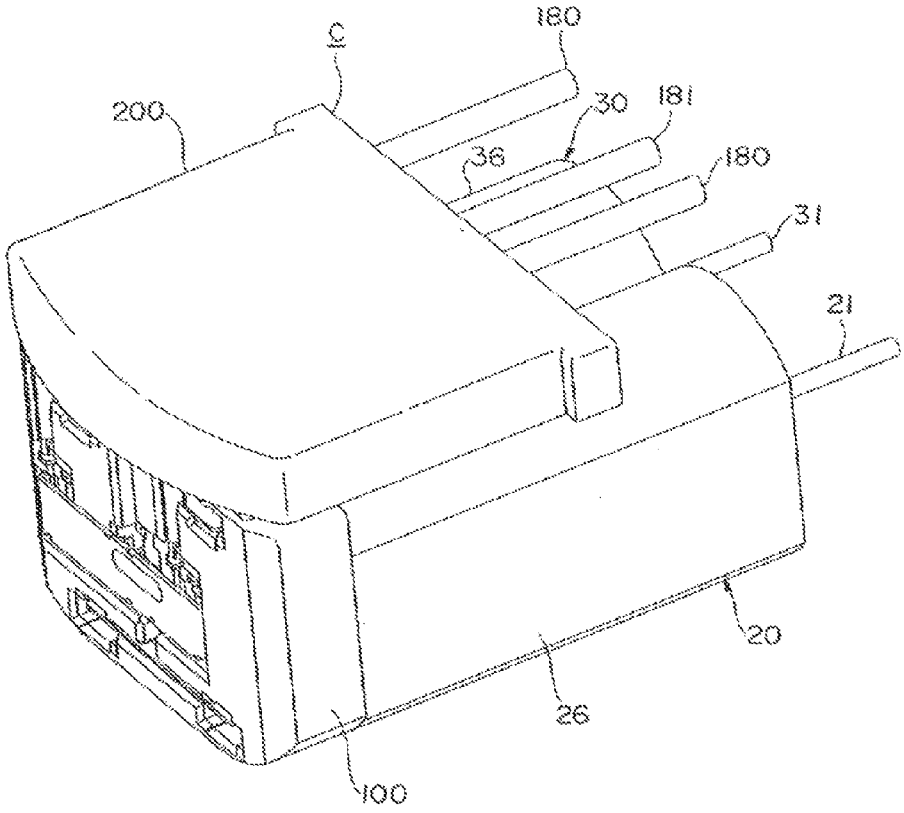
[FIG. 1] A perspective view of a motor unit according to an embodiment of the present invention.
Figure 2:
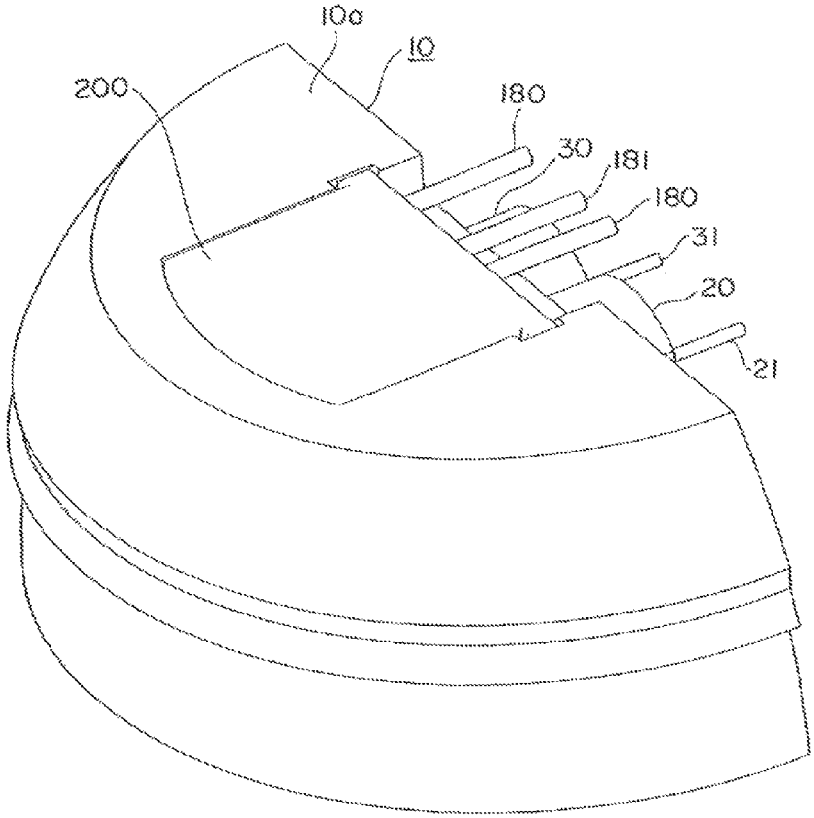
[FIG. 2] A view showing the motor unit according to the embodiment as incorporated in a casing.
Figure 3:
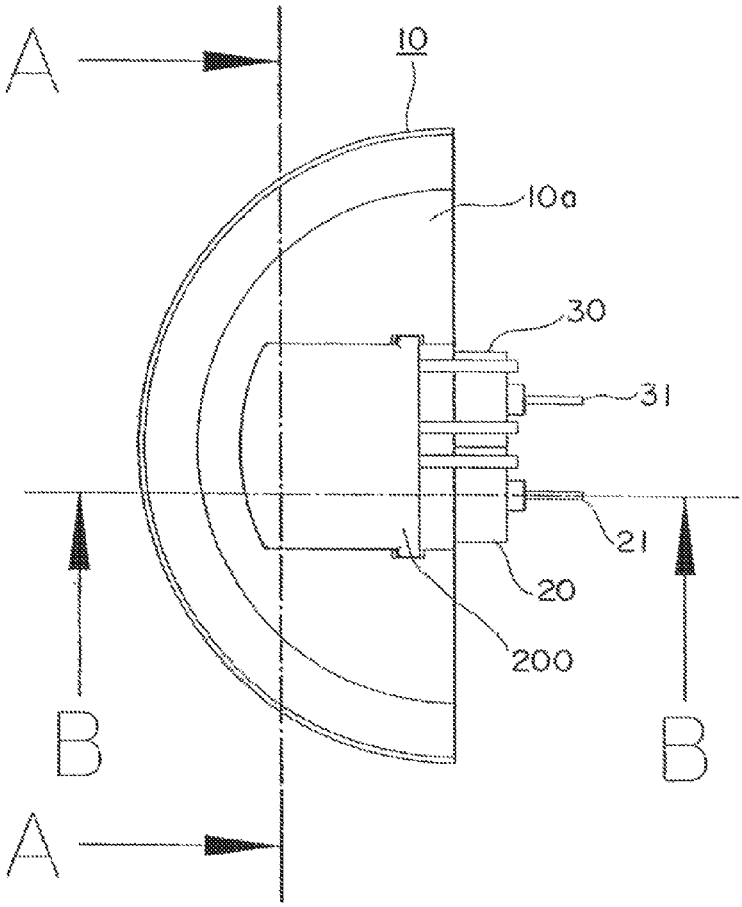
[FIG. 3] A plan view of the unit shown in FIG. 2.
Figure 4:
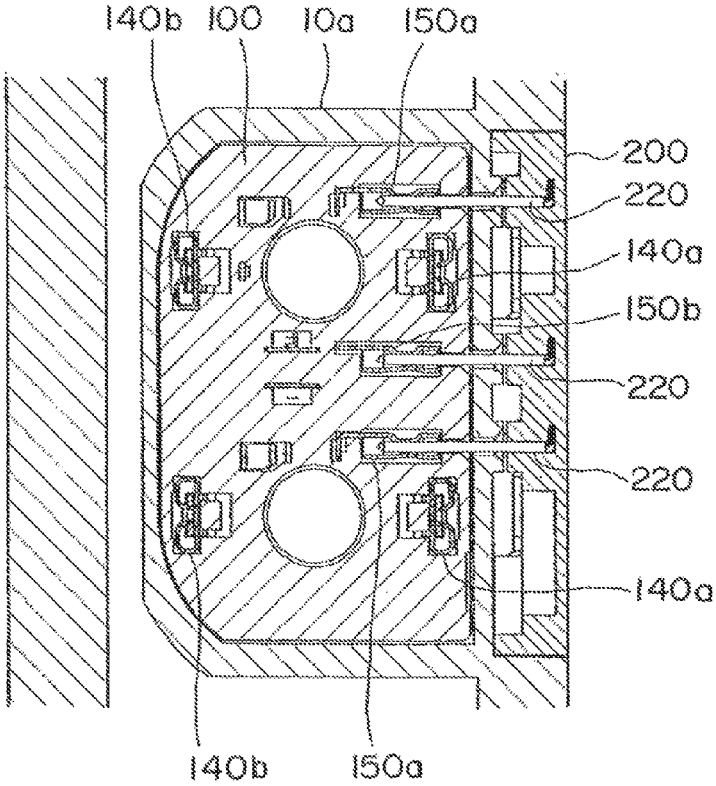
[FIG. 4] A sectional view taken along the line A-A of FIG. 3.
Figure 5:
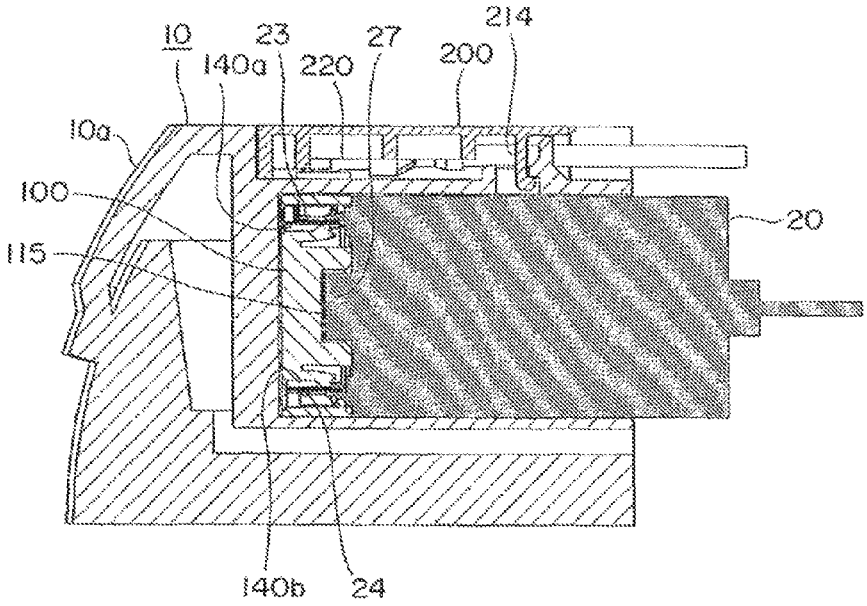
[FIG. 5] A sectional view taken along the line B-B of FIG. 3.
Figure 6:
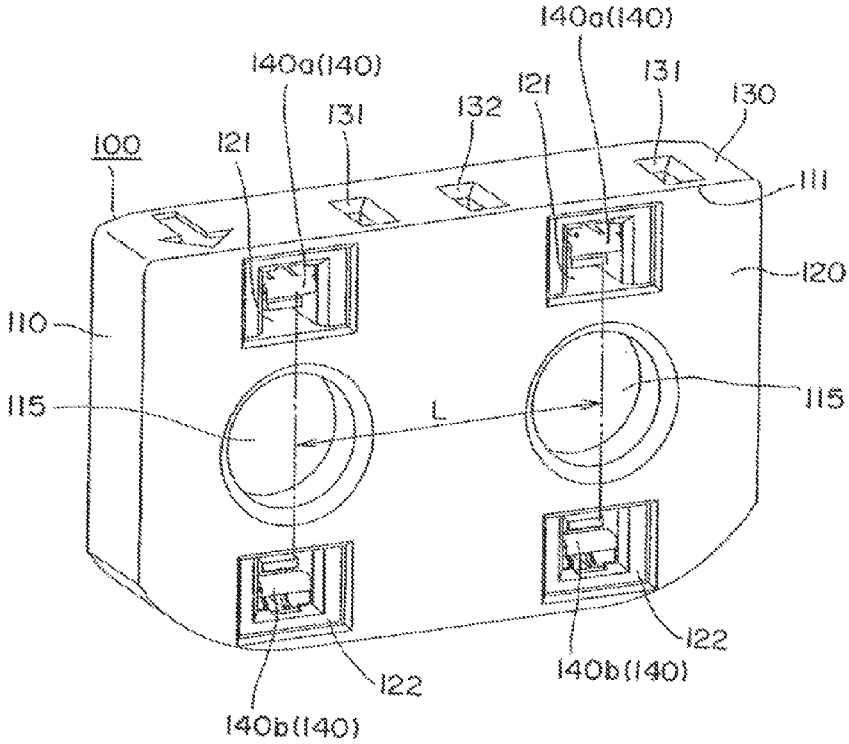
[FIG. 6] A perspective view of a relay connector as seen from the motor connecting surface (front surface) side.
Figure 7:
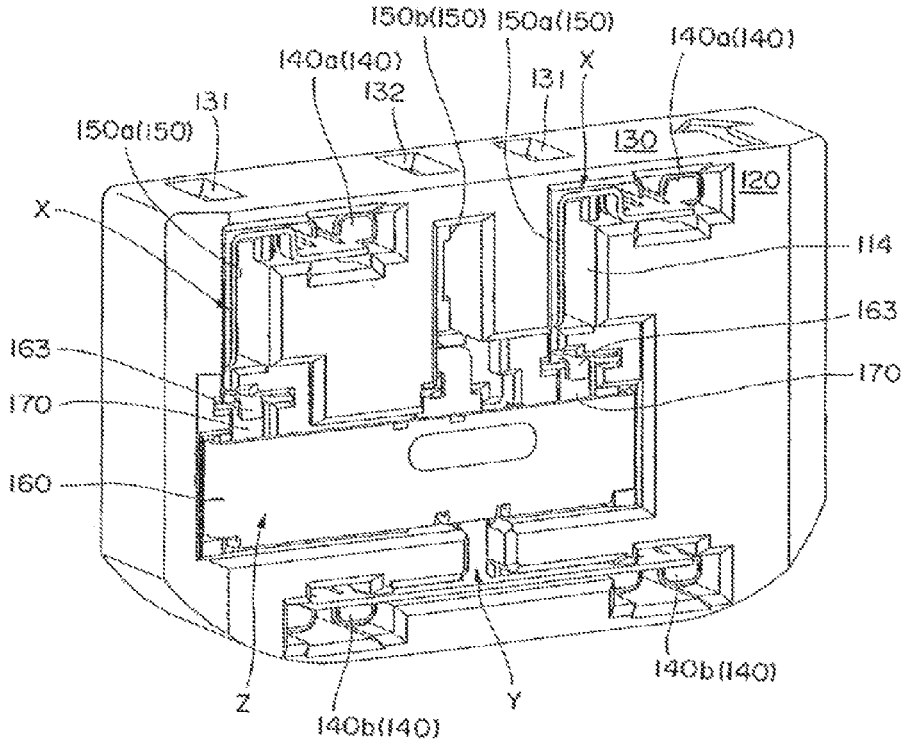
[FIG. 7] A perspective view of the relay connector as seen from the rear surface side.
Figure 8:
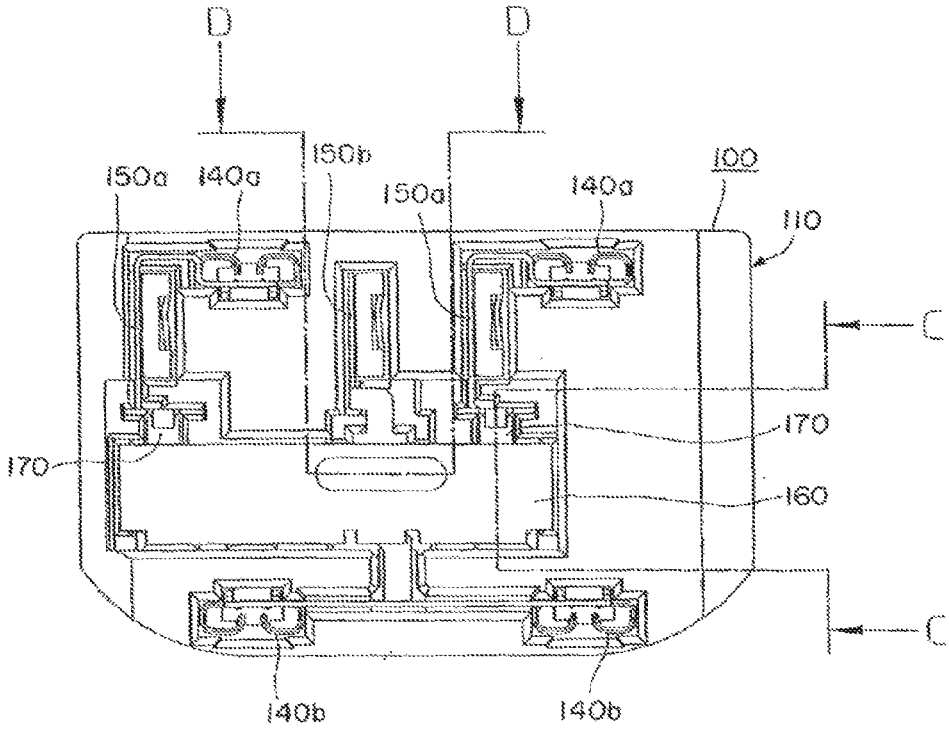
[FIG. 8] A rear view of the relay connector.
Figure 9:
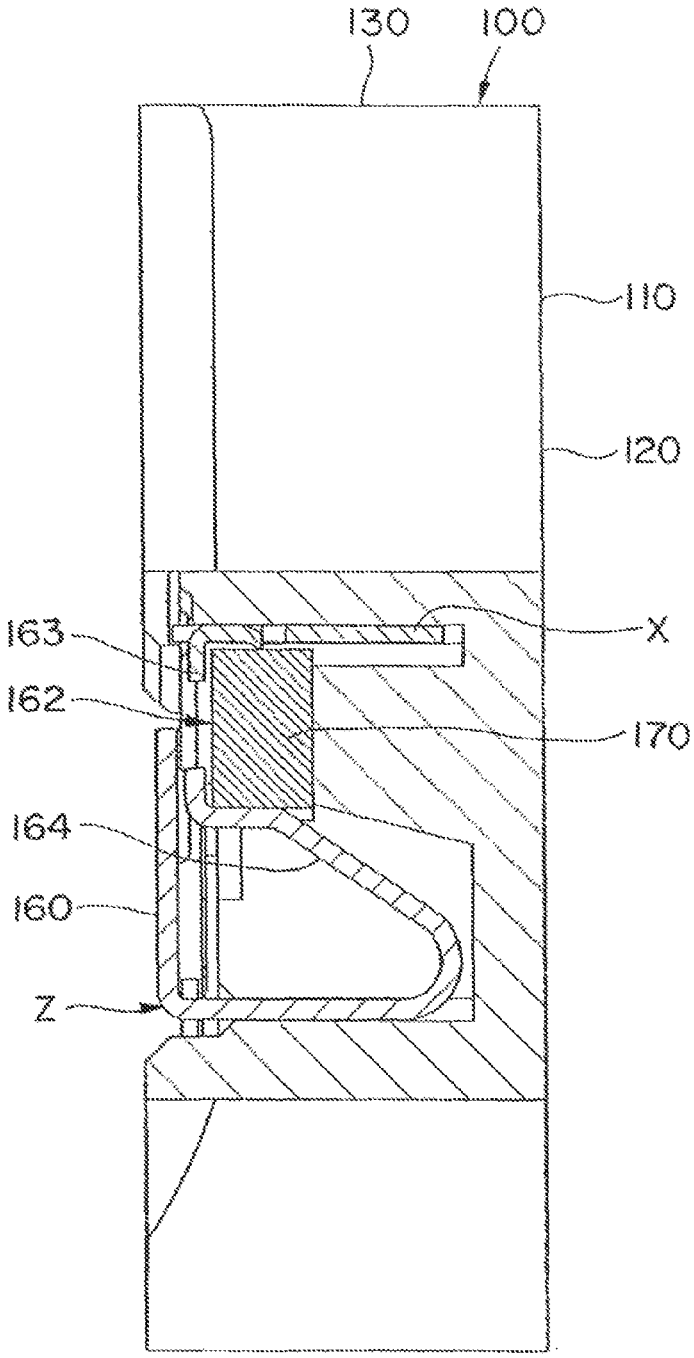
[FIG. 9] A sectional view taken along the line C-C of FIG. 8.
Figure 10:
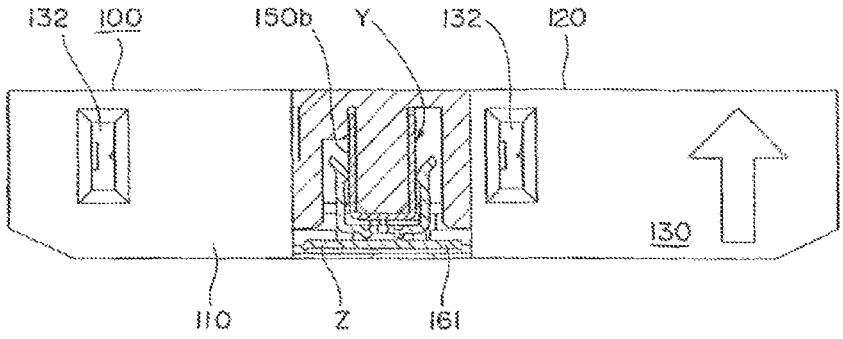
[FIG. 10] A sectional view taken along the line D-D of FIG. 8.
Figure 11:
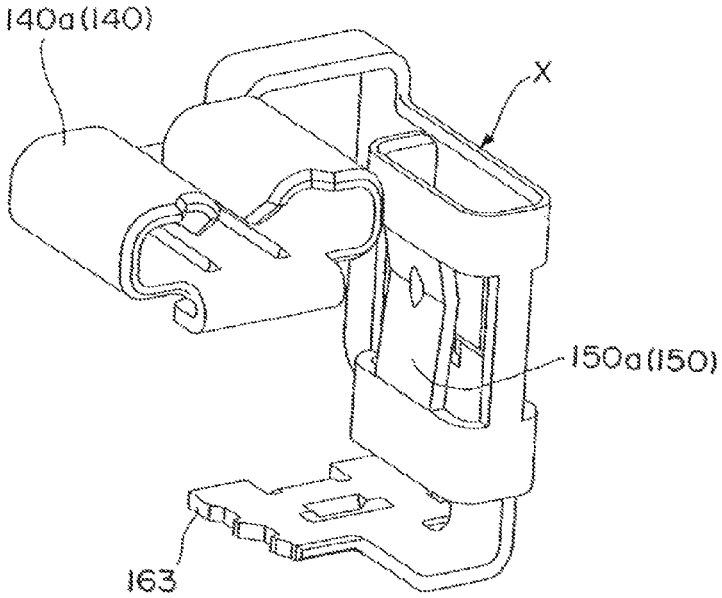
[FIG. 11] A perspective view of a power contact.
Figure 12:
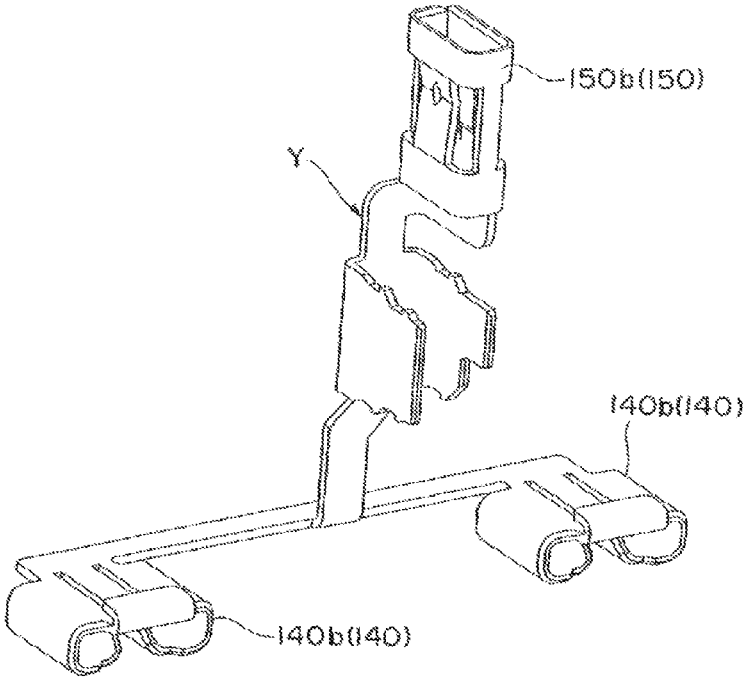
[FIG. 12] A perspective view of a grounding contact.
Figure 13:
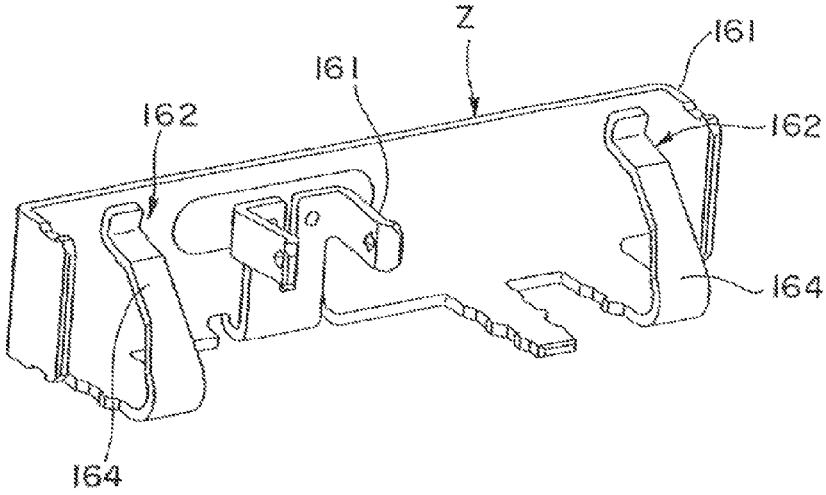
[FIG. 13] A perspective view of a connecting contact.
Figure 14:
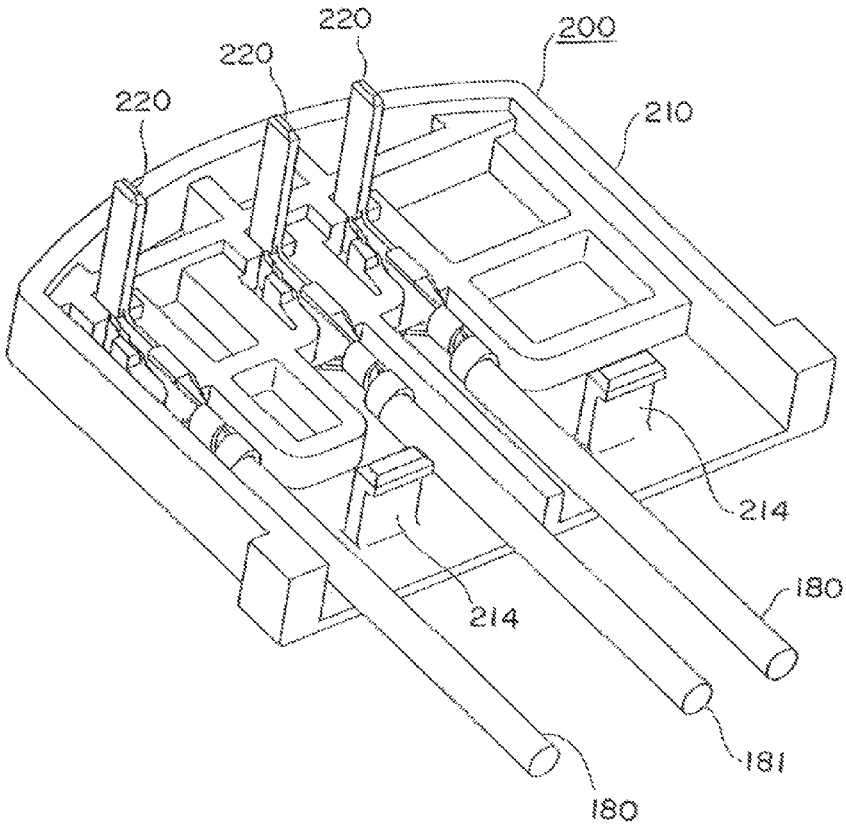
[FIG. 14] A perspective view of an external connector.
Figure 15:
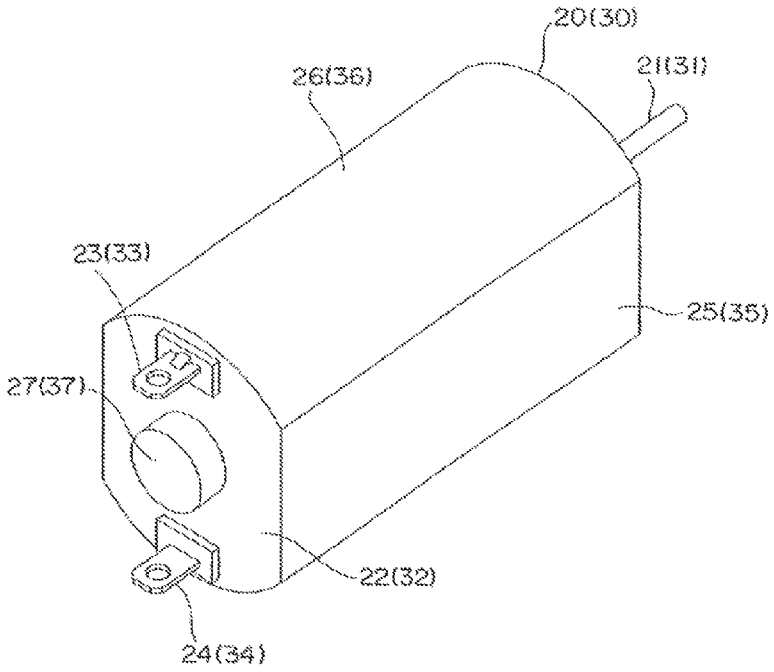
[FIG. 15] A view illustrating a general-purpose motor.
Figure 16:
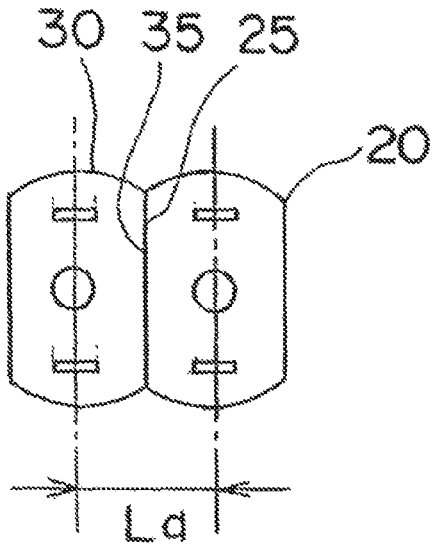
[FIG. 16] A view illustrating how motors according to the present invention are mounted.
Figure 17:
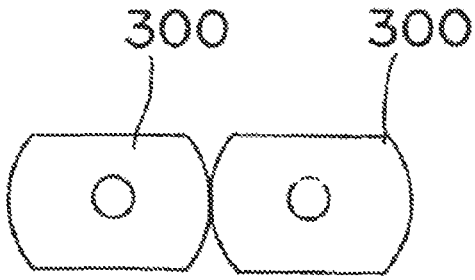
FIG. 17 (PRIOR ART)
[FIG. 17] A view illustrating how conventional motors are mounted.
Figure 18:
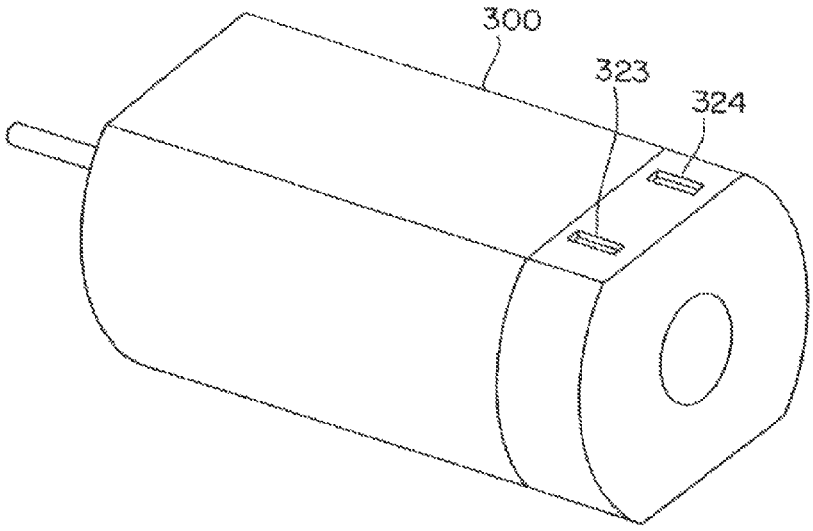
FIG. 18 PRIOR ART
[FIG. 18] A perspective view of a motor having terminals

What is claimed is:

1. Relay connector for connecting motors with each other, the motors each having a back plate supporting an end portion of a rotor and a pair of motor terminals provided to the back plate, and for supplying electric power fed through external terminals to the motors, the relay connector comprising a housing having a first bonding surface and a second bonding surface, wherein:

the first bonding surface has a first relay terminal connected to the motor terminals of the respective motors;

the second bonding surface is provided in a surface different from the first bonding surface and has a second relay terminal connected to the external terminals; and the first relay terminal and the second relay terminal are electrically connected with each other within the housing.

2. Relay connector according to claim 1, wherein the second relay terminal is provided in the second bonding surface such that a direction in which the external terminals are connected to the second relay terminal is at a right angle to a direction in which the first relay terminal is connected to the motor terminals.

3. A relay connector according to claim 1, wherein the first relay terminal comprises power supply terminals connected to the motor terminals used to supply power to the respective motors, and ground short-circuit terminals connected to the motor terminals used for grounding connection of the respective motors;

the respective power supply terminals are provided independently within the housing in correspondence with the respective motors; and the respective ground short-circuit terminals are provided within the housing (110) in a state in which the ground short-circuit terminals are connected with each other.

4. A relay connector according to claim 1, wherein the relay connector comprises a connecting terminal provided within the housing, for connecting the power supply terminals and the ground short-circuit terminals with each other; and the connecting terminal comprises an electronic element mounting portion for electrically connecting, between the power supply terminals and the ground short-circuit terminals, an electronic element for preventing generation of noise by the motors.

5. A relay connector according to claim 1, wherein the motor surrounds an outer periphery of the rotor and has parallel side end surfaces at its radially opposing portions; and the power supply terminals and the ground short-circuit terminals are provided in the first bonding surface in conformity with a layout enabling a mounting arrangement in which the side end surfaces of the pair of motors are opposed to each other and the side end surfaces are in close proximity to each other.

* * * * *